US005503782A

United States Patent [19]

Dyrud et al.

[11] Patent Number: 5,503,782

[45] Date of Patent: Apr. 2, 1996

[54] METHOD OF MAKING SORBENT ARTICLES

[75] Inventors: James F. Dyrud, New Richmond, Wis.; Thomas I. Insley, Lake Elmo, Minn.; Daniel E. Meyer, Stillwater, Minn.; Cynthia Y. Tamaki, Arden Hills, Minn.; Donald E. Young, Forest Lake, Minn.

[73] Assignee: Minnesota Mining and Manufacturing Company, St. Paul, Minn.

[21] Appl. No.: 179,204

[22] Filed: Jan. 14, 1994

Related U.S. Application Data

[63] Continuation-in-part of Ser. No. 11,403, Jan. 28, 1993, abandoned.

[51] Int. Cl.[6] ..... B29C 70/28

[52] U.S. Cl. ..... 264/6; 264/115; 264/122; 156/167; 428/903

[58] Field of Search ..... 264/6, 12, 115, 264/122, 518; 156/167, 169; 428/36.3, 377, 398, 903

[56] References Cited

U.S. PATENT DOCUMENTS

| | | | |
|---|---|---|---|
| 3,020,585 | 2/1962 | Berthon et al. | 18/2.5 |
| 3,073,735 | 1/1963 | Till | 156/38 |
| 3,739,913 | 6/1973 | Bogosian | 210/242 |
| 3,933,557 | 1/1976 | Pall | 156/167 |
| 3,971,373 | 7/1976 | Braun | 128/146 |
| 3,981,100 | 9/1976 | Weaver et al. | 47/58 |
| 4,001,067 | 1/1977 | Johnson | 156/159 |
| 4,021,281 | 5/1977 | Pall | 156/167 |
| 4,100,324 | 7/1978 | Anderson et al. | 428/288 |
| 4,112,159 | 9/1978 | Pall | 428/36 |
| 4,118,531 | 10/1978 | Hauser | 428/224 |
| 4,357,379 | 11/1982 | Sloan et al. | 428/113 |
| 4,366,067 | 12/1982 | Golding et al. | 210/671 |
| 4,429,001 | 1/1984 | Kolpin et al. | 428/283 |
| 4,497,712 | 2/1985 | Cowling | 210/691 |
| 4,594,202 | 6/1986 | Pall et al. | 264/8 |
| 4,604,313 | 8/1986 | McFarland et al. | 428/172 |
| 4,659,478 | 4/1987 | Stapelfeld et al. | 210/690 |
| 4,689,186 | 8/1987 | Bornat | 264/6 |
| 4,737,394 | 4/1988 | Zafiroglu | 428/102 |
| 4,792,399 | 12/1988 | Haney et al. | 210/484 |
| 4,813,948 | 3/1989 | Insley | 604/366 |
| 4,902,544 | 2/1990 | Kim et al. | 428/36 |
| 4,933,229 | 6/1990 | Insley et al. | 428/224 |
| 4,965,129 | 10/1990 | Bair et al. | 428/398 |
| 4,973,503 | 11/1990 | Hotchkiss | 428/36 |
| 4,988,560 | 1/1991 | Meyer et al. | 428/297 |
| 5,024,789 | 6/1991 | Berry | 264/6 |
| 5,165,821 | 11/1992 | Fischer et al. | 405/63 |

FOREIGN PATENT DOCUMENTS

| | | |
|---|---|---|
| 0518693A1 | 12/1992 | European Pat. Off. . |
| 59-43134 | 3/1984 | Japan . |
| 1-131667 | 5/1989 | Japan . |
| 437193 | 11/1967 | Switzerland . |

OTHER PUBLICATIONS

3M Product Bulletin, "Maintenance Sorbents," N. 70–0704–0625–4(227.5) DPI.

Wente, Van A., "Superfine Thermoplastic Fibers," *Industrial Engineering Chemistry,* vol. 48, pp. 1342 et seq. (1956).

Wente, Van A., Boone, C. D.; and Fluharty, E. L., Report No: 4364 of the Naval Research Laboratories, Mayu 25, 1954, "Manufacture of Superfine Organic Fibers".

*Primary Examiner*—Mary Lynn Theisen

*Attorney, Agent, or Firm*—Gary L. Griswold; Walter N. Kirn; Carole Truesdale

[57] ABSTRACT

A method of making a microfibrous sorbent article is provided. The method includes the steps of a) extruding molten thermoplastic fiber forming polymer from multiple orifices in a fiber-forming die, said orifices being aligned along the face of the die; b) attenuating the fibers in a stream of hot air to form a fiber stream of microfibers; and c) collecting said microfibers on a collector having a forming surface, said surface being aligned with said die and substantially parallel to and equidistant from said die such that the fibers form a spirally wound microfibrous sorbent article which is supported on its exterior surface by said forming surface and which is drawn across said forming surface substantially parallel to said die. Also provided is a microfibrous sorbent article prepared according to the method.

18 Claims, 3 Drawing Sheets

METHOD OF MAKING SORBENT ARTICLES

This application is a continuation-in-part application of application Ser. No. 08/011,403, filed Jan. 28, 1993.

FIELD OF THE INVENTION

The invention relates to a method of making sorbent articles formed from microfibers and, optionally, staple fibers and particulate material and articles so made. The articles are in the form of elongate bodies such as, for example, booms.

DESCRIPTION OF RELATED ART

A variety of materials, delivered in numerous configurations have been used for sorption of liquids. These materials include boom and pillow configurations consisting of a casing filled with particulate sorbent products such as clay, cellulose, chopped corn cobs, or chopped microfibrous materials as well as sheet materials formed from wood pulp fibers or blown microfibers. A casing can also be filled with sorbent sheet or roll good materials.

U.S. Pat. No. 4,497,712 (Cowling) describes an expendable pillow in the form of a container of highly permeable, surfactant coated fabric having at least one pocket partially filled with a granular absorbent material such as ground corn cobs. The pillow is described as being light weight, having an absorption capacity in excess of 500% and capable of floating on liquids.

U.S. Pat. No. 4,366,067 (Golding et al.) discloses bags or booms of porous material filled with an oil absorbent, particulate polyisocyanurate synthetic foam material which is used to enclose and absorb oil spilled on water or hard surfaces.

U.S. Pat. No. 4,659,478 (Stapelfeld, et al.) describes an oil absorbing member and method which includes an elongate tubular member filled with a highly absorbent particulate material of capillary nature having a wicking action such as ground corn cobs. The tubular member is closed at each end and can be arranged around a tool base as a continuous absorbing member.

U.S. Pat. No. 4,792,399 (Haney et al.) describes a liquid collecting and retaining device consisting of a tubular, triangular shaped casing of a material which is permeable to liquids, which is partially filled with a material that collects and retains liquids passing through the casing, and which is incapable of itself passing through the casing.

U.S. Pat. No. 4,965,129 (Bair et al.) discloses a sausage-shaped liquid-absorbing article which includes within a porous fabric, fine, fibrous particles of flash-spun polyethylene, optionally particles of foamed organic polymer, and an effective amount of wetting agent. The article is capable of absorbing oils or aqueous liquids in amounts equal to at least six times the weight of the particles.

U.S. Pat. No. 4,902,544 (Kim et at.) describes a leak resistant absorbent article made from a tubular casing of liquid permeable fabric wherein the casing is loosely filled with a mixture of particles of a crosslinked hydrocolloid and particles of other liquid absorbing material such as saw dust, crushed corn cobs, cotton linters, wood pulp and the like.

U.S. Pat. No. 4,737,394 (Zafiroglu) discloses an oil-absorbing article comprised of an outer fabric which encloses fibrous oil absorbing particles such as flash-spun linear polyethylene. The porous fabric is a nonwoven fibrous polyolefin layer of polyethylene or polypropylene that is stitch-bonded with an elastic thread.

U.S. Pat. No. 3,739,913 (Bogosian) describes an elongate body of oil absorbing material and flotation material including longitudinal reinforcing means whereby a plurality of bodies can be disposed in end-to-end relationship for temporarily fencing oil spills on water for retention and absorption of the oil. The body contents comprise oil absorbing fibers which are natural or synthetic or combination thereof and may include a flotation material interspersed therewith to aid buoyancy of the body even after saturation of the fibers by oil. In addition to the above referenced patents, there are a number of commercially available spill containment and recovery articles. For example, 3M Company, St. Paul, Minn., sells a family of liquid sorbent articles designed to contain and recover liquid spills. These articles, which are based on sorbent microfibrous materials, include sheet goods for wiping and final cleanup operations, pillows of chopped microfibrous materials contained within a covering designed for intermediate quantity liquid recovery, and booms of chopped microfibrous materials contained within an elongate casing having a substantially circular cross-section, which are used to recover larger spills. These materials are described, for example, in 3M product bulletin "Maintenance Sorbents" N. 70-0704-0625-4(227.5) DPI.

None of these spill containment and absorbent recovery systems is completely satisfactory because of certain problems. Those products containing particulate sorbent materials such as clay, cellulose, foams, vermiculite or chopped corn cobs frequently have escape of dust particulates rendering cleanup inconvenient and messy. Also shifting or pocketing of particulate material within the casing often causes concentrating of the sorbent in some areas while creating voids of sorbents in other areas. When sorbent recovery systems of the type having sorbent particulate contained within a casing are compressed to extract sorbed fluids, the particulate material within the casing can shift and pocket creating voids of sorbent in portions of the casing. This renders the sorbent article less useful for performing spill containment and recovery upon redeployment.

U.S. Pat. No. 4,357,379 (Sloan, et al.) discloses a modification of the meltblowing process to form a rod having a relatively dense, rigid skin in which the fiber portions are oriented primarily in a longitudinal direction with respect to the axis of the product, and a less dense core where the fiber portions are oriented primarily in the transverse direction with respect to the axis of the product. The products are made by melt blowing fibers and intercepting them by a fiber collecting and forming device which permits a relatively heavy build-up of fibers in a lip portion surrounding the central portion. The collecting device may be funnel shaped, trumpet shaped or in the form of continuous belts which are shaped such that in combination the form a cylindrical opening at their nip. The fibers in the lip portion being deposited while still in a thermoplastic state, thermally bond together. As fibers are continuously deposited on the collecting and forming device, the product thus formed is withdrawn at a rate synchronized with collection of fibers such that the aforesaid build-up is maintained, and such that the lip portion is folded back over the central portion by the collecting and forming device to form the rod as described. The fibrous product has sufficient rigidity and resiliency for use in filters, ink pen reservoirs, etc.

U.S. Pat. No. 3,933,557 (Pall) discloses a process for the continuous production of nonwoven webs in cylindrical or sheet form from thermoplastic fibers, spinning the fibers continuously from a melt onto a rotating mandrel and winding them up on the mandrel to form a generally spirally wound cylinder.

U.S. Pat. No. 4,594,202 (Pall et al.) describes a method of manufacturing cylindrical fibrous structures comprising the steps of: extruding synthetic, polymeric material from a fiberizing die and attenuating the extruded polymeric material to form microfibers by the application of one or more gas streams directed toward a rotating mandrel and a forming roll in operative relationship with the mandrel; cooling the synthetic, polymeric microfibers prior to their collection on the mandrel to a temperature below that at which they bond or fuse together, thereby substantially eliminating fiber-to-fiber bonding; and collecting the cooled microfibers on the mandrel as a nonwoven, synthetic fibrous mass while applying a force on the exterior surface of the collected microfibers by the forming roll; wherein the process variables are controlled to form a cylindrical fiber structure with at least the major portion of the fibrous mass having substantially constant void volume.

U.S. Pat. No. 5,165,821 (Fischer et al.) discloses a combined skirted oil-sorbing boom and oil-sorbing sweep which has a buoyant inner core and an oil-sorbent outer core of a spirally wound sheet of polymeric, oleophilic, hydrophobic microfibers. Adhesively bonded to a sheet of the microfibers at the outer face of the outer core is an open mesh netting of polymeric monofilaments fused at their crossings. The netting and the sheet to which it is adhered extend from the outer core to form a depending skirt which acts as a barrier to oil that is being sorbed by the microfibers. The buoyant inner core can be an open-cell foam that sorbs oil slowly, thus supplementing the oil-sorbing capability without significant loss of freeboard.

U.S. Pat. No. 4,973,503 (Hotchkiss) discloses microfiber tow or tube products wherein larger diameter, short fibers are mixed with microfibers. The mixture is formed by physically entangling microfibers (having an average diameter in the range of up to about 10 microns and being discontinuous) containing 10% to 90% of shorter fibers with the microfibers being predominately aligned parallel to the axis of the tow and the mixture being bonded at contact points between microfibers and the shorter fibers. The method of making the mixed fiber tow or tube products includes the steps of forming a melt with thermoplastic material and extruding it through one or more series of orifices arranged in a rounded or spinneret configuration at the die tip. The extruded melt is contacted with a first stream of gas whereby it is formed into a network of physically entangled microfibers that are attenuated to microfiber size. A second gas stream is used having entrained larger diameter, short fibers, and the gas streams are merged to form a mixture of fibers. The mixture is collected as a tow or tube having the desired fiber orientation. Uses for such tows or tubes are described as including beauty coils, tampons, cigarette filters, bottle stuffers, and with additives, other products such as insulating caulk and the like.

U.S. Pat. No. 3,073,735 (Till et al.) discloses a method for producing filters wherein fibers from a plurality of fiber-forming means are suspended in a gas stream and deposited on a collecting surface. The fibers of each fiber-forming means differ in physical characteristics from those of the other means, e.g., one of the fibers may be preformed, such as staple textile fibers and the other fiber may be produced in situ by feeding a plastic fiber-forming composition from a reservoir to a spraying unit which comprises a spraying tube positioned in the center of a nozzel through which air is forced at a high velocity. The fibers are deposited on the collecting device in such intermingled relationship that there is a gradual gradation in fiber property along one dimension of the filter. U.S. Pat. No. 4,604,313 (McFarland et al.) discloses selective layering of super absorbents in meltblown substrates. A meltblown material containing wood fiber is formed on a continuous formanious belt. The belt carrying this layer then passes beneath at least one further source of meltblown fiber into which super absorbent is added along with wood fibers.

SUMMARY OF THE INVENTION

The present invention provides a method of making a microfibrous sorbent article comprising a) extruding molten thermoplastic fiber-forming polymer from multiple orifices in a fiber-forming die, said orifices being aligned along the face of the die;

b) attenuating the fibers in a stream of hot air to form microfibers; and c) collecting said microfibers on a collector having a forming surface, said surface being aligned with said die and substantially parallel to and substantially equidistant from said die such that the fibers form a spirally wound boom which is supported on its exterior surface by said forming surface and which is drawn across said forming surface substantially parallel to said die.

The term "substantially parallel" as used herein to describe the relation between the collector surface and the die means that one end of the collector surface is angled no more than about 60° from the die than the other end.

Optionally, the collector may include a rotating nip roll downstream from the collector surface to enhance spiral formation of the boom.

The present invention also provides a microfibrous sorbent article comprising an elongate boom having a substantially circular cross-section, said boom comprising a spirally wound web of melt blown microfibers prepared by a) extruding molten thermoplastic fiber-forming polymer from multiple orifices in a fiber-forming die, said orifices being aligned along the face of the die;

b) attenuating the fibers in a stream of hot air to form microfibers; and c) collecting said microfibers on a collector having a forming surface, said surface being aligned with said die and substantially parallel to and substantially equidistant from said die such that a spirally wound boom is formed which is supported on its exterior surface by forming surface and which is drawn across said forming surface substantially parallel to said die.

The articles, or booms, prepared according to the present invention are capable of rapid sorption of liquid and high liquid retention. The booms do not experience shifting, pocketing or compacting of sorbent material during storage, use or after reclamation of sorbed liquid. Incineration of used booms generally results in low ash generation. The booms are integral and handleable both before and after immersion in liquid because the collected fibers are extensively entangled within each layer as well as entangled between layers. The booms are particularly useful for removing oily matter from bodies of water. The articles of the invention may further contain sorbent particulate materials and bulking staple fiber.

DETAILED DESCRIPTION OF THE INVENTION

Figure 1:
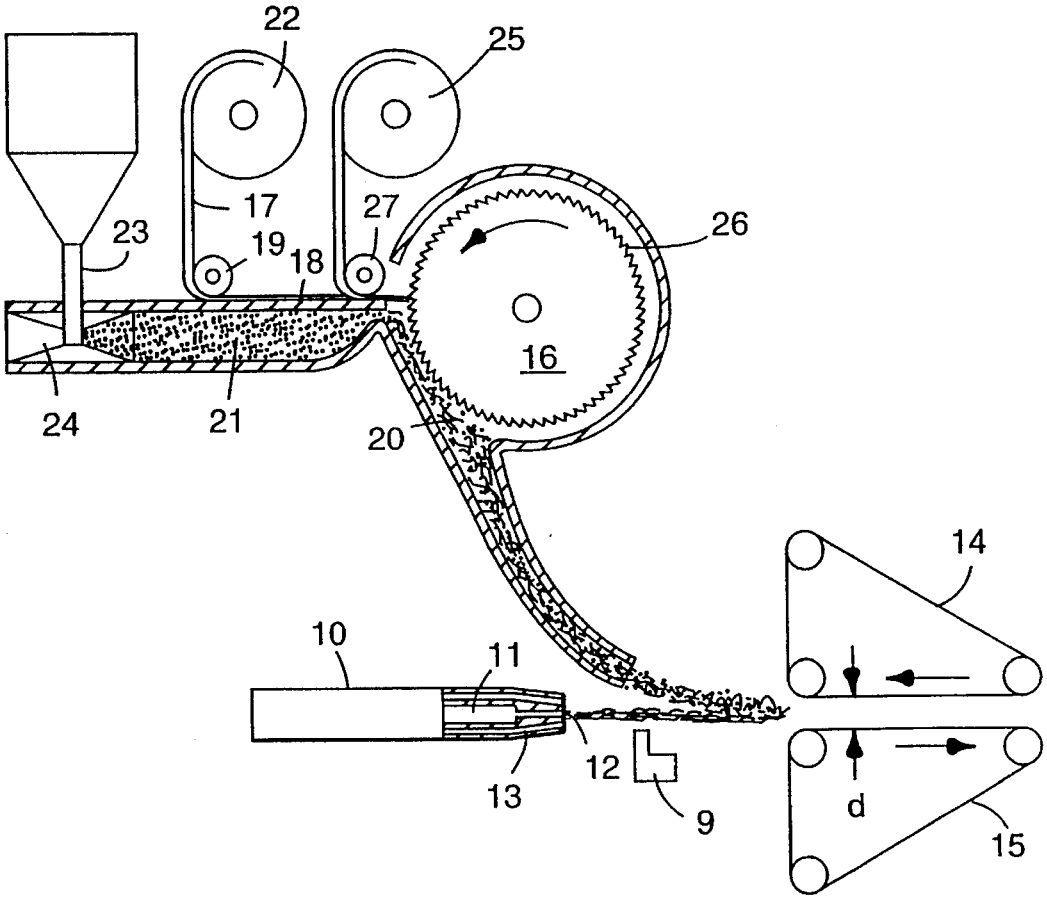
FIG. 1 is a side view of an apparatus useful in practicing the present invention.

Representative apparatus useful for preparing the boom of the present invention is shown schematically in FIGS. 1 and 2. Except for the collector, the apparatus is generally similar to that taught in U.S. Pat. No. 4,118,531 for preparing a web of melt-blown fibers and crimped bulking fibers.

The fiber-blowing portion of the illustrated apparatus can be a conventional structure as taught, for example, in Wente, Van A. "Superfine Thermoplastic Fibers", in Industrial Engineering Chemistry, Vol. 48, pages 1342 et seq (1956), or in Report No. 4364 of the Naval Research Laboratories, published May 25, 1954, entitled "Manufacture of Superfine Organic Fibers" by Wente, Van A.; Boone, C. D.; and Fluharty, E. L. Such a structure includes a die 10 which has an extrusion chamber 11 through which liquefied fiber-forming material is advanced; die orifices 12 arranged in lines across the forward end of the die and through which the fiber-forming material is extruded; and cooperating gas orifices 13 through which a gas, typically heated air, is forced at very high velocity. The high-velocity gaseous stream draws out and attenuates the extruded fiber-forming material, whereupon the fiber-forming material solidifies as fibers travel to a forming surface of a collector.

The forming surface may be any surface which causes the fibers to impinge on the spirally wound boom as it is being formed, the spirally winding boom being supported on its exterior surface by the forming surface as the boom is being formed. A preferred collector is shown as a pair of closed-loop belts 14 and 15, typically a finely perforated screen, but the belt can be of fabric, wire, film, rubber or combinations thereof. Alternatively, instead of the closed loop belts shown, the collector can be curved surfaces, for example a pair of rotating drums, rollers or cones. The collector may be stationary or rotating as shown in FIGS. 2*a*, 2*b*, 2*c* and 2*d*. The collector surfaces should be at least as wide as the die face portion containing orifices. The collector surfaces preferably can be about 0.5 to 10 cm apart, more preferably about 2.5 to 5 cm apart, shown as distance d in FIG. 1. Most preferably, the collector surfaces are about 1.5 to 2.5 cm apart on the input side and 2.5 to 8 cm apart on the output side. The collector surfaces are substantially parallel to the die, i.e., one end of the collector surface is angled no more than about 60° from the die than the other end. Preferably the collector surfaces are about 0.3 to 1 m from the die, more preferably about 0.5 to 0.7 m. The collector surfaces preferably travel at a rate of about 0 to 100 m/min, more preferably 5 to 60 m/min, most preferably 10 to 30 m/min. The portion of the collector surface which contacts the boom as it is being formed preferably has a radius of about 1 to 30 cm, more preferably about 10 to 20 cm. The collector surfaces are substantially parallel to the die face with the input side of the collector 28 being that which the microfibers initially contact and the output side 29 being that where the boom 31 is formed.

Gas-withdrawal apparatus may be positioned behind the screen to assist in deposition of fibers and removal of gas. Surfactant may be applied to the web by optional spray bar 9. Alternatively, two dies may be used and arranged so that the streams of melt blown fibers issuing from them intersect to form one stream that continues to a collector 14 and 15. Preferably, the die has at least about 10 orifices, more preferably at least about 100 orifices, most preferably at least about 500 orifices. Generally, the die has no more than about 4000 orifices. In a preferred embodiment of the invention, the microfibrous web is formed around stabilizing member 30 which can be in the form of rope, cable, wire, tubing, foam, etc. and which provides added strength to the boom as well as means for attaching one boom to another boom.

Figure 3:
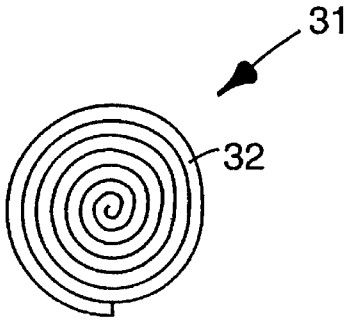
FIG. 3 is a perspective view of the microfibrous sorbent article prepared according to the present invention.
Figure 4:
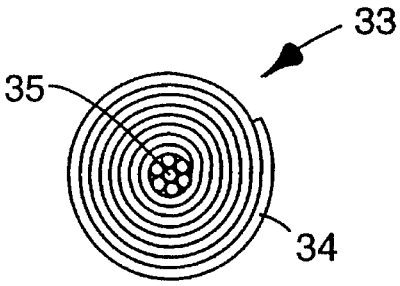
FIG. 4 is a perspective view of a microfibrous sorbent article having a stabilizing member of the present invention.

As can be seen in FIG. 3, boom 31 has a substantially circular cross-section and comprises spirally wound layer of microfibrous web 32. As can be seen in FIG. 4, in a preferred embodiment of the invention, boom 33 has microfibrous web 34 spirally wound around stabilizing member 35.

The booms of the present invention have a substantially uniformly distributed microfibrous structure over the length of the boom due to the contribution of fiber from each orifice in the die over the length of the boom. The booms of the invention generally have a diameter of about 2 cm to about 20 cm. The booms are continuously formed and can be cut to desired lengths. The weight of the booms of the invention can generally range from about 150 g/m to 1500 g/m.

Microfibers useful in the invention may be formed from nearly any fiber-forming material. Melt blown microfibers are greatly preferred for booms of the invention, but solution blown microfibers in which the fiber forming material is made liquid by inclusion of a volatile solvent can also be used. U.S. Pat. No. 4,001,067 describes useful apparatus and procedures for preparing a web of such fibers; however, in preparing booms of this invention fiber-forming material is generally extruded through a plurality of adjacent orifices rather than the single orifice shown in the patent. Representative polymers for forming melt-blown microfibers include polyolefins such as polypropylene and polyethylene, polyesters such as polyethylene terephthalate and polybutylene terephthalate, polyamides, polyurethane, polystyrene-polybutadiene-polystyrene block copolymers, and other polymers as known in the art. Useful polymers for forming microfibers from solution include polyvinyl chloride, acrylics, and acrylic copolymers, polystyrene, and polysulfone.

The effective average diameter of the microfibers is generally less than about 10 microns. The effective fiber diameter is calculated according to the method set forth in Davies, C. N., "The Separation of Airborne Dust and Particles," Institution of Mechanical Engineers, London, Proceedings 1B, 1952. To form useful booms, the aspect ratio (ratio of length to diameter) of the microfibers should approach infinity, though blown microfibers are known to be discontinuous.

In preferred embodiments of the invention, the boom also contains crimped bulking fibers and/or sorbent or neutralizing particulate material. The sorbent particulate material can be in the form of microfiber microwebs or substantially solid particles such as, for example, wood pulp fibers, modified starches, diatomaceous earth, high-molecular weight acrylic polymers containing hydrophilic groups, alkylstyrene particles and activated carbon. Neutralizing sorbent particulate material can include sodium bicarbonate, calcium hydroxide, borax, potassium dihydrogen phosphate, disodium hydrogen phosphate and potassium hydrogen phthalate. The boom may also contain other materials such as mold retardant, e.g., calcium propionate, and other preservatives, bacteriostatic agents, e.g., urea-formaldehyde resins and n-butyl-2-cyanoacrylate.

When crimped bulking fibers are incorporated, they are introduced into the stream of blown microfibers in the illustrative apparatus shown in FIG. 1 through the use of a lickerin roll 16 disposed above the microfiber-blowing apparatus. A web 17 of bulking fibers, typically a loose, nonwoven web provided as roll 22 such as prepared on a garnet machine or RANDO-WEBER, is propelled along a table 18 under a drive roll 19 where the leading edge engages against the lickerin roll 16. The lickerin roll turns in the direction of the arrow and picks off fibers from the leading edge of the web 17, separating the fibers from one another. The separated fibers are conveyed in an air stream through an inclined trough or duct 20 and into the stream of blown microfibers where they become mixed with the blown microfibers. The air stream is generated inherently by rotation of the lickerin roll, or that air stream may be augmented by use of an auxiliary fan or blower operating through a duct 21 as known in the art.

The crimped bulking fibers have a continuous wavy, curly or jagged character along their length. The number of crimps, i.e., complete waves or cycles, per unit length can vary rather widely but generally is in the range of about 1 to 10 crimps/cm, preferably at least 2 crimps/cm. The size of the crimped bulking fiber can also vary widely but generally is in the range of about 1 to 100 decitex, preferably about 3 to 40 decitex. The crimped bulking fibers should have, as a minimum, an average length sufficient to include at least one complete crimp and preferably at least three or four crimps. Generally, the crimped bulking fibers average about 2 to 15 centimeters in length, preferably about 2 to 10 centimeters in length.

The amount of crimped bulking fibers included in the boom of the present invention can range from 0 to 90 weight percent but preferably is in the range of about 5 to 50 weight percent. The addition of the crimped bulking fibers reduces the density or solidity of the boom and generally permits greater sorption capacity of liquids.

When the boom of the invention is to be used for sorption of aqueous liquid, particulate materials such as wood pulp fiber or sorbent particulate can be used. The preferred sorbent materials are generally substantially solid super sorbent particles which rapidly sorb large quantities of liquids and retain the liquid under pressure. Examples of such substantially solid supersorbent particles include, for example, water-insoluble modified starches, such as those described in U.S. Pat. No. 3,981,100 and high molecular weight acrylic polymers containing hydrophilic groups. A wide variety of commercially available water-insoluble, water-sorbing particles typically sorb 20 or more times their weight of water and preferably 100 or more times their weight of water. With such modified starches and acrylic polymers the amount of water sorbed generally decreases as impurities in the water, such as salts and ionic species, increase. Among sorbent particles useful for sorbing liquids other than water are alkylstyrene sorbent particles such as IMBIBER BEADS available from Dow Chemical Company which generally sorb about 5 to 10 times or more their weight of liquid.

The amount of sorbent particulate included in the boom of the present invention can range from 0 to 90 weight percent but preferably is in the range of about 10 to 50 weight percent. The sorbent particulate material may be introduced into the microfiber stream from hopper 23 through metering device 24 and ducts 21 and 20.

Microfiber microwebs may also be used as sorbent particles in the booms of the present invention. The microfiber microwebs have a relatively dense nucleus with numerous individual fibers and/or fiber bundles extending therefrom. The extended fibers and fiber bundles provide an anchoring means for the microfiber microwebs when they are incorporated into the boom. The nucleus of the microfiber microwebs is preferably in the range of about 0.05 to 4 mm, more preferably in the range of about 0.05 to 4 mm, more preferably about 0.2 to 2 min. The extending fibers and/or fiber bundles preferably extend beyond the nucleus to provide an overall diameter of about 0.07 to 10 mm, more preferably about 0.1 to 5 mm. Such microfiber microwebs are described in U.S. Pat. No. 4,813,948 (Insley) which is incorporated herein by reference.

The microfiber microwebs useful in the present invention can be prepared from source microfiber webs such as, for example, those disclosed in Wente, Van A., "Superfine Thermoplastic Fibers," Industrial Engineering Chemistry, vol. 48, pp. 1342–1346 and in Wente, Van A. et al., "Manufacture of Superfine Organic Fibers," Report No. 4364 of the Naval Research Laboratories, published May 25, 1954, or from microfiber webs containing particulate matter such as those disclosed, for example, in U.S. Pat. No. 3,971,373 (Braun), U.S. Pat. No. 4,100,324 (Anderson et al.), and U.S. Pat. No. 4,429,001 (Kolpin et al.), which references are incorporated herein as exemplifying preparation of source microfiber webs.

The microfiber microwebs are prepared by mechanically divellicating, or tearing apart, the source microfiber web. Divellication can be accomplished, for example, by subjecting the source microfiber web to a lickerin as shown in FIG. 1. Source microfiber web 25 is fed to lickerin 16 which has, protruding from the surface thereof, teeth 26. The teeth must be at a sufficiently low angle, e.g., preferably less than about 60°, more preferably less than about 40°, from the surface of the lickerin to produce the microwebs having a relatively dense nucleus with fibers and fiber bundles extending therefrom. The lickerin rotates, counter clockwise as depicted in FIG. 1, at a rate sufficient to divellicate source microfiber web 25 to form discrete microfiber microwebs. The source web is generally held in contact with the lickerin by means of a nose bar or delivery roll 27. An air stream provided through duct 21 serves to remove microfiber microwebs from the lickerin teeth. The microfiber microwebs can be collected for later incorporation into the nonwoven webs of the invention or the microfiber microwebs can be supplied directly from the lickerin into the base microfiber stream formed at die 10.

In addition to or in place of adding substantially solid sorbent particulate directly into the microfiber boom, microfiber source webs can be loaded with solid sorbent-type particulate materials and can be divellicated to provide microfiber microwebs which include useful amounts of solid particulate material. In the microfiber source web from which the microfiber microwebs are divellicated, sorbent particles can comprise at least about 5 $g/m^2$ for each 100 $g/m^2$ of microfiber, preferably as much as 150 $g/m^2$ for each 100 $g/m^2$ microfiber, and in some applications as much as 500 $g/m^2$ for each 100 $g/m^2$ microfiber.

The amount of microfiber microwebs included in the boom of the present invention can range from 0 to 90 weight percent but preferably is in the range of about 10 to 50 weight percent.

When crimped bulking fibers and/or sorbent particulate materials are fed into the base microfiber stream, the materials are mixed by the air turbulence present and then continue to the collector 14 and 15 where the fibers form a continuous boom. Under close examination, the microfibers and crimped bulking fibers and/or sorbent particulate material are found to be thoroughly mixed. For example, the web is free of clumps of crimped fibers, i.e., collections a centimeter or more in diameter of many crimped fibers, such as would be obtained if a chopped section or multi-ended tow of crimped filament were unseparated or if crimped fibers were balled together prior to introduction into a microfiber stream.

The optional crimped bulking fibers and/or the sorbent particulate material can be selectively loaded into the boom of the present invention. If the crimped bulking fibers and/or the sorbent particulate material are to be loaded throughout the boom, the crimped bulking fibers and/or the sorbent particulate material are fed into the microfiber stream across the full width of the die. If the crimped bulking fibers and/or the sorbent particulate material are to be located predominantly in the interior portion of the boom, the crimped bulking fibers and/or the sorbent particulate material is fed into the microfiber stream at the portion of the die which provides fiber to the input side of the collector. Preferably, the crimped bulking fibers and/or the sorbent particulate material are fed into about 20 to 90 percent, more preferably 50 to 75 percent, of the die width when loaded into the interior portion of the boom. In this type of structure where the crimped bulking fibers and/or the sorbent particulate material are selectively loaded into the interior portion of the boom, the outer portion of the boom, formed from only the blown microfibers, substantially eliminates any dusting out of sorbent particulate material.

When the boom is to be used for vapor suppression, i.e., sorption of vapors or contaminants from the air,-the particulate material is an adsorbent material of the type commonly used to remove the particular vapor or contaminant. Typical particles for use in filtering or purifying booms include, for example, activated carbon, alumina, sodium bicarbonate and silver particles which remove a component from a fluid by adsorption, chemical reaction or amalgamation or such particulate catalytic agents as hopcalite which catalyze the conversion of a hazardous component, as well as clay and clay treated with acidic solutions such as acetic acid or alkaline solutions such as aqueous sodium hydroxide. The adsorbent particles may vary in size from about 5 to 3000 micrometers in average diameter.

Preferably the particles are less than about 1500 micrometers in average diameter.

The amount of adsorbent particulate included in the boom can range from 0 to 90 weight percent but preferably is in the range of about 10 to 50 weight percent. The adsorbent particulate material may be introduced into the microfiber stream from hopper 23 through metering device 24 and ducts 21 and 20.

The following examples further illustrate this invention, but the particular materials and amounts thereof in these examples, as well as the conditions and details, should not be construed to unduly limit this invention. In the examples all parts and percentages are by weight unless otherwise specified. All booms were prepared using equipment similar to that depicted in FIGS. 1 and 2 unless otherwise indicated.

Oil Sorbency Test

Modified ASTM Test Method F726 9.1.3 was used to determine oil sorbency. A 24 inch (61.5 cm) long boom sample is weighed and placed in a 61 cm×91 cm tray containing a drain screen in the bottom. Mineral oil having a viscosity of 50–60 SUS at 38° C. is added to the tray to a depth sufficient to cover the boom. The sample is allowed to submerge and the time to full saturation, by visual observation, is recorded. The sample is then left undisturbed for an additional period of time equal to at least 20% of the elapsed time to saturation. After the additional time, the sample is removed from the tray using the drain screen and is allowed to drain for 30 seconds. The boom sample is again weighed and the amount of oil remaining in the sample is determined. The oil sorption is the amount of oil remaining in the sample per dry sample weight (g/g). Preferably the oil sorbency is at least about 5 g/g, more preferably 10 g/g.

Tensile Strength

A boom sample is placed in an INSTRON tensile tester Model 1123, available from Instron Corporation, having jaw spacing of 25.4 cm and jaw faces 3.8 cm wide. Nylon webbing 2.5 cm wide is used to cinch the boom near each end of the test sample 12.7 cm apart and the nylon webbing is placed in the jaws. The sample is tested at a crosshead speed of 20 cm/min. The peak tensile is recorded in N/boom.

Fabric Stiffness

Fabric stiffness was determined using ASTM Test Method D 1388-64 and is reported as bend length.

Fluid Recovery

Fluid recovery was determined generally using ASTM Test Method F726 10.3. A boom sample is weighed (WDRY), saturated, drained and reweighed (WSAT) as in the Oil Sorbency Test and the amount of oil sorbed is calculated. The sample is then placed in a roller type wringer (Model 76-3 from Lake City Industries, Inc.) and the mineral oil is extracted from the sample using 3.5 kg/cm$^2$ pressure supplied to the roller surface by a pressure regulated cylinder adapted to the wringer. The extracted sample is then weighed (WEXT). The percent recovery is then calculated using the equation:

$$1[(WEXT-WDRY)/(WSAT-WDRY)].$$

Vapor Sorption—Carbon Tetrachloride

A boom sample, preconditioned at 100 C. for 4 hours, was weighed and placed in a sealed desiccator; on a porous ceramic plate positioned about 2 cm above 1 L carbon tetrachloride. After 24 hours, the boom was removed from the desiccator and weighed. The boom was reweighed at selected time intervals. Add-on weights were calculated in grams of carbon tetrachloride per gram of boom.

EXAMPLE 1

In Example 1, a source web was prepared of polypropylene (FINA Grade 70 MF, available from Fina Oil and Chemical Company) microfibers having an effective fiber diameter of 8 microns. The web had a basis weight of 410 g/m$^2$ and a solidity of 6.3%. The web was divellicated using a lickerin having 6.2 teeth/cm$^2$ at a speed of 2650 rpm to form sorbent microweb particles. The sorbent microweb particles were blended with polyester staple fiber (EASTMAN Type 431, 15 denier, 3 crimps/cm, available from Eastman Chemical Products, Inc.) and fed into a base polypropylene (FINA Grade 70 MF) microfiber web having microfibers of 8 micron effective fiber diameter. Surfactant (10.3 weight percent based on the weight of the base web TRITON X-100, available from Union Carbide Corp.) and dye (0.5 weight percent based on the weight of the base web #1607-052-15M/Gray, available from Spectrum Colors, Inc.) were added to the base web using the procedure of U.S. Pat. No. 4,933,299. The web was collected on a collector such as that shown in FIG. 1, The top belt was 2.8 m in length and to the bottom belt was 3.2 m in length. The belt radius of each belt at the collection point was 3.8 cm. The distance between the belts was 5 cm at the collection point. The extrusion weight was 0.42 kg/hr/cm, the collection distance ( distance of collector from the die) was 0.48 m, the surface speed of collector belts was 12 m/min, and the boom was produced at a rate of 5.9 m/min. The boom contained 53 weight percent microfiber microwebs, 4 weight percent staple fiber and 43 weight percent microfiber base web.

EXAMPLES 2–6

In Example 2, sorbent microweb particles were prepared as in Example 1 except the surfactant and dye were omitted. The sorbent microweb particles were blended with polyester staple fiber (EASTMAN Type 431) and fed into a base polypropylene (FINA Grade 70 MF) microfiber web having microfibers of 8 micron effective fiber diameter. The sorbent microweb particles and staple fiber were fed into about 75% of the width of the base web on the input side. The web was collected on a collector as in Example 1. The boom was produced at a rate of 3.2 m/min. The boom contained 54 weight percent microfiber microwebs, 4 weight percent staple fiber and 42 weight percent microfiber base web.

In Example 3, a boom was prepared as in Example 2, except the boom was produced at a rate of 4.8 m/min and foam pipe insulation (Type CL-75, 1.9 cm diameter, 1.6 cm thick, available from Halstead Industries, Inc.) was inserted as a structural member.

In Example 4, a boom was prepared as in Example 2, except the boom was produced at a rate of 4.4 m/min and polyethylene tubing (3.18 cm OD, 0.6 mm thick wall, Item No: 2400, available from Drainage Industries, Inc.) was inserted as a structural member.

In Example 5, a boom was prepared as in Example 2, except the staple fiber was omitted. The boom contained 57 weight percent microfiber microwebs and 43 weight percent microfiber base web.

In Example 6, a boom was prepared as in Example 2, except the boom was produced at a rate of 3.4 m/min and contained 11 weight percent staple fiber, 47 weight percent microfiber microwebs and 42 weight percent microfiber base web.

The lineal weight and diameter of the booms were measured and the oil sorbency, tensile strength and stiffness and boom formation speed were determined. The results are set forth in Table 1.

TABLE 1

| Ex No. | Diameter (cm) | Lineal Weight (g/m) | Oil Sorbency (g/g) | Tensile Strength (N/boom) | Stiffness (cm bend length) | Boom Formation Speed (rotations/min.) |
|---|---|---|---|---|---|---|
| 1 | 6.2 | 300 | 8.7 | 304 | — | 61.64 |
| 2 | 11.3 | 568 | 15.1 | 598 | 22.3 | 33.82 |
| 3 | 11.5 | 381 | 14.8 | 824 | — | 33.23 |
| 4 | 9.9 | 410 | 12.0 | 647 | — | 38.60 |
| 5 | 11.5 | 535 | 13.4 | 696 | 22.1 | 33.23 |
| 6 | 10.7 | 535 | 15.6 | 569 | 25.3 | 35.72 |

As can be seen from the data above, increasing the amount of staple fiber from 0% (Example 5) to 4% (Example 2) to 11% (Example 6) increases sorbency and decreases tensile strength.

EXAMPLES 7–10

Figure 2B:
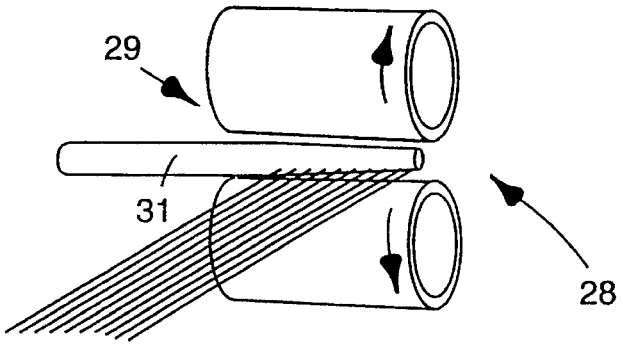
FIG. 2*b* is a perspective view of an alternative collector for use in the present invention.
Figure 2C:
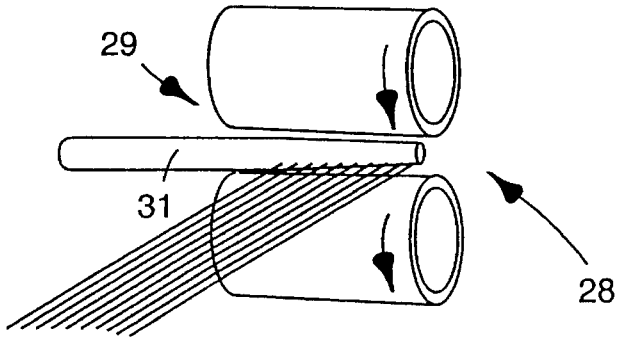
FIG. 2*c* is a perspective view of an alternative collector for use in the present invention.
Figure 2D:
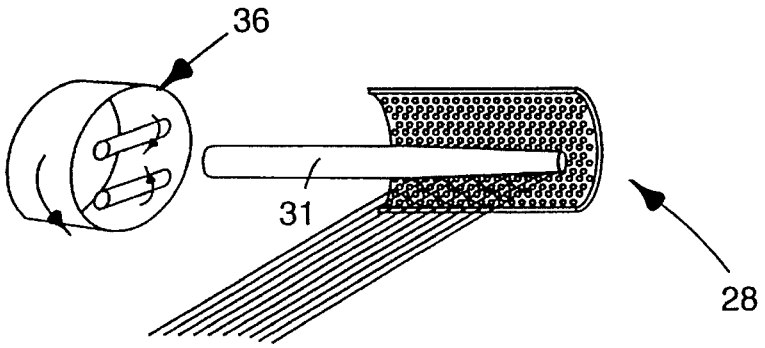
FIG. 2*d* is a perspective view of an alternative collector for use in the present invention.
Figure 2A:
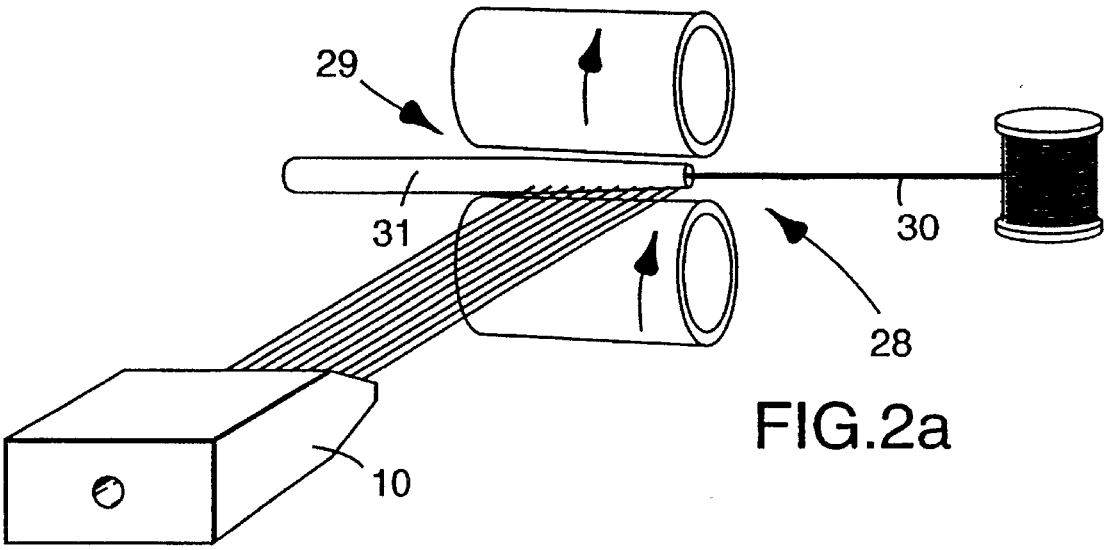
FIG. 2*a* is a perspective view of a portion of the apparatus useful in practicing the present invention.

In Example 7, a boom was prepared as in Examples 2–6 except the collector was a pair of drums as shown in FIG. 2*a* and the staple fiber was fed only into about 75% of the width of the web on the input side. Each drum had a radius of 20.3 cm and the drums were 2.5 cm apart on the input side and 5 cm apart on the output side. The collector was 0.66 m from the die on the input side and 0.71 cm from the die on the output side and the production rate was 3.5 m/min. The boom contained 50 weight percent microfiber microwebs, 5 weight percent staple fiber and 45 weight percent microfiber base web.

In Example 8, a boom was prepared as in Example 7, except the production rate was 8.9 m/min and the collector distance was 0.69 m on the input side and 0.74 m on the output side.

In Example 9, a boom was prepared as in Example 8, except no staple fiber or microfiber microwebs were added to the base web and the production rate was 0.84 m/min.

In Example 10, a boom was prepared as in Example 7, both the microwebs and staple fiber were fed only into about 75% of the width of the die on the input side, the production rate was 4.4 m/min, the boom contained 50 weight percent microfiber microwebs, 5 weight percent staple fiber and 45 weight percent microfiber base web and the web was formed around two ropes (braided polypropylene, 0.64 cm diameter, available from Crowe Rope Co.).

The surface speed of the collector drums and the boom formation speed are set forth in Table 2. The lineal weight and diameter of the booms were measured and the oil sorbency, tensile strength and stiffness were determined. The results are set forth in Table 3.

TABLE 2

| | Collector Surface Speed | | |
|---|---|---|---|
| Ex. | Top Drum (Meters/Min.) | Bottom Drum (Meters/Min.) | Boom Formation Speed (Rotations/Min.) |
| 7 | 23.2 | 26.8 | 42.4 |
| 8 | 23.2 | 26.8 | 35.4 |
| 9 | 30.8 | 20.4 | 35.4 |
| 10 | 23.2 | 26.8 | 42.4 |

TABLE 3

| Ex. No. | Diameter (cm) | Lineal Weight (g/m) | Oil Sorbency (g/g) | Tensile Strength (N/boom) | Stiffness (cm bend length) |
|---|---|---|---|---|---|
| 7 | 11.7 | 475 | 15.2 | 637 | 16.7 |
| 8 | 6.8 | 188 | 12.7 | 324 | 16.2 |
| 9 | 12.4 | 901 | 10.7 | 2997 | 27.1 |
| 10 | 9.6 | 381 | 14.1 | 696 | 21.3 |

In comparing Examples 7 (microwebs and staple fiber) and 9 (no microwebs or staple fibers) it can be seen that adding microwebs and staple fiber to the base web increases sorbency and decreases the bend length and tensile strength.

EXAMPLE 11

A boom was prepared as in Example 1 except the microwebs and the staple fiber were added to only the center 50% of the die stream, the boom formation speed was 56 rotations/min, and the production rate was 5.3 m/min. The boom contained 45 weight percent microfiber microwebs, 13 weight percent staple fiber and 42 weight percent microfiber base web. The boom was 6.8 cm in diameter and weighed 335 g/m. The oil sorbency of the boom was 13.4 g/g and the tensile strength was 196 N/boom. The oil recovery of the boom was 85.7%.

EXAMPLE 12

A source web was prepared of 18.6 weight percent polypropylene (FINA Grade 70 MF) microfibers having an effective fiber diameter of 8 microns and 81.4 weight percent activated coconut carbon (Type RFM-C, available from Calgon Carbon Corp.). The source web was divellicated as in Example 1 to form sorbent particulate microwebs. The sorbent particulate microwebs and polyester staple fiber (EASTMAN Type 431) were fed into a base polypropylene microfiber web having microfibers of 8 micron effective fiber diameter. The sorbent particulate microwebs were fed only into about 50% of the width of the die stream in the center and the staple fiber was fed only into about 75% of the width of the die stream on the input side. The extrusion rate was 0.42 kg/hr/cm. The web was collected as in Example 7 with a collection distance of 0.69 m on the input side and 0.74 m on the output side. The surface speed of the top drum was 23.2 m/min, the surface speed of the bottom drum was 26.8 m/min, the boom formation speed was 35.4 rotations/min and the boom was produced at a rate of 3.5 m/min. The boom had a lineal weight of 516 g/m and contained 53.9 weight percent sorbent particulate microwebs, 4.3 weight percent staple fiber and 41.8 microfiber base web.

The boom was tested for vapor sorption of carbon tetrachloride. For comparative purposes, the boom of Example 8 which contained no activated carbon was also tested for vapor sorption of carbon tetrachloride. The results are set forth in Table 4.

TABLE 4

| Time minutes | Example 12 g/g | Example 8 g/g |
|---|---|---|
| 0 | 0.34 | 0.24 |
| 1 | 0.33 | 0.21 |
| 2 | 0.32 | 0.19 |
| 3.5 | 0.32 | 0.16 |
| 5 | 0.31 | 0.14 |
| 10 | 0.29 | 0.09 |
| 15 | 0.29 | 0.07 |
| 20 | 0.28 | 0.06 |
| 25 | 0.27 | 0.05 |
| 30 | 0.27 | 0.04 |
| 40 | 0.26 | 0.04 |
| 50 | 0.26 | 0.03 |
| 60 | 0.25 | 0.03 |
| 90 | 0.24 | 0.02 |
| 120 | 0.23 | 0.02 |
| 150 | 0.23 | 0.01 |
| 180 | 0.22 | 0.01 |
| 200 | 0.22 | 0.01 |
| 245 | 0.22 | 0.02 |
| 270 | 0.22 | 0.02 |
| 24 Hrs | 0.18 | 0.00 |

As can be seen from the data in Table 4, the boom containing the activated carbon showed excellent vapor sorption.

EXAMPLES 13 AND 14

In Examples 13 and 14 booms were prepared as in Examples 7–10, using 45 weight percent microfiber microwebs, 10 weight percent polyester staple fiber and 45 weight percent base web. The extrusion rate was 0.42 kg/hr/cm and the production rate was 3.5 m/min in Example 13 and 3.6 m/min in Example 14. The collecting drums were 0.66 m from the die on the input side and on the output side 0.71 m from the die in Example 13 and 0.79 m from the die in Example 14. In each of Examples 13 and 14 the surface speed of the top drum was 23.2 m/min, the surface speed of the bottom drum was 13.8 m/min, and the boom formation speed was 28.3 rotations/min. The lineal weight, diameter, sorbency and tensile strength were determined and the values are set forth in Table 5.

TABLE 5

| No. | Diameter (cm) | Lineal Weight (g/m) | Oil Sorbency (g/g) | Tensile Strength (N/boom) |
|---|---|---|---|---|
| 13 | 12.6 | 483 | 15.7 | 726 |
| 14 | 12.8 | 462 | 17.2 | 706 |

As can be seen from the data in Table 5, as the collector distance was increased on the output side, the sorbency increased.

EXAMPLE 15

In Example 15, a source web was prepared of polypropylene (FINA Grade 100 MF, available from Fina Oil and Chemical Company) microfibers having an effective fiber diameter of 8 microns. The web had a basis weight of 410 g/m$^2$ and a solidity of 6.3%. The web was divellicated using a lickerin having 6.2 teeth/cm$^2$ at a speed of 2650 rpm to form sorbent microweb particles. The sorbent microweb particles were blended with polyester staple fiber (CELANESE Type 295, 15 denier, 3.7 crimps/cm, available from Hoechst Fiber Industries, Inc.) and fed into a base polypropylene (FINA Grade 100 MF) microfiber web having microfibers of 8 micron effective fiber diameter. The web was collected on a collector such as that shown in FIG. 2*d*. The forming surface was a perforted screen 1.14 m in length with a curved surface. The depth of the curve was 0.15 m and the height of the opening was 0.36 m. The extrusion weight was 0.42 kg/hr/cm, the collection distance (distance of collector from the die) was 0.69 m on the input side and 0.74 m on the output side. The boom was produced at a rate of 2.9 m/min and the boom formation speed was 56 rotations per min at a rotating nip roll 36 in FIG. 2*d*. The boom contained 39 weight percent microfiber microwebs, 17 weight percent staple fiber and 44 weight percent microfiber base web. The microwebs and the staple fiber were added only to the center 75% of the die stream. The diameter was 11.2 cm, the lineal weight was 577 g/m, the oil sorbency was 11.8 g/g, the tensile strength was 748 N/boom and the stiffness was 46 cm bend length.

Various modifications and alterations of this invention will be apparent to those skilled in the art without departing from the scope and spirit of this invention and this invention should not be restricted to that set forth herein for illustrative purposes.

We claim:

1. A method of making a microfibrous sorbent article comprising the steps of a) extruding molten thermoplastic fiber forming polymer from multiple orifices in a fiber-forming die, said orifices being aligned along the face of the die;

b) attenuating the fibers in a stream of hot air to form a fiber stream of microfibers; and c) collecting said microfibers on a collector having a forming surface, said surface being aligned with said die and substantially parallel to and equidistant from said die such that the fibers form a spirally wound microfibrous sorbent article which is supported on its exterior surface by said forming surface and which is drawn across said forming surface substantially parallel to said die.

2. The method of claim 1 wherein said forming surface comprises two rotating collector surfaces.

3. The method of claim 2 wherein the collector surfaces are about 0.5 to 10 cm apart.

4. The method of claim 2 wherein the collector surfaces are about 1.5 to 2.5 cm apart on an input side and 2.5 to 8 cm apart on an output side.

5. The method of claim 1 wherein the forming surface is about 0.3 to 1 m from the die.

6. The method of claim 2 wherein said surfaces travel at a rate of about 5 to 60 m/min.

7. The method of claim 2 wherein that portion of the collector surface which contacts the spirally wound microfibrous sorbent article as it is being formed preferably has a radius of about 1 to 30 cm.

8. The method of claim 1 wherein the collector further includes a rotating nip roll downstream from the forming surface to enhance spiral formation of the spirally wound microfibrous sorbent article.

9. The method of claim 1 wherein crimped bulking fibers are fed into said fiber stream.

10. The method of claim 9 wherein said crimped bulking fibers are fed into about 20 to 90% of of the die width when loaded into the interior portion of the spirally wound microfibrous sorbent article.

11. The method of claim 1 wherein sorbent particulate microfiber microwebs are fed into said fiber stream.

12. The method of claim 11 wherein said sorbent particulate microfiber microwebs are fed into about 20 to 90% of of the die width when loaded into the interior portion of the spirally wound microfibrous sorbent article.

13. The method of claim 1 wherein said article is formed around a stabilizing member.

14. The method of claim 1 wherein sorbent particulate material is fed into the fiber stream.

15. The method of claim 1 wherein said collector forming surface is a stationary convex collector.

16. The method of claim 15 wherein said convex surface is perforated screen.

17. A method of making a microfibrous sorbent article comprising the steps of a) extruding molten thermoplastic fiber forming polymer from multiple orifices in a fiber-forming die, said orifices being aligned along the face of the die;

b) attenuating the fibers in a stream of hot air to form a fiber stream of microfibers; and c) collecting said microfibers on a collector having a forming surface comprising two rotating collector surfaces, said surface being aligned with said die and substantially parallel to and equidistant from said die such that the fibers form a spirally wound microfibrous sorbent article which is supported on its exterior surface by said forming surface and which is drawn across said forming surface substantially parallel to said die.

18. A method of making a microfibrous sorbent article comprising the steps of a) extruding molten thermoplastic fiber forming polymer from multiple orifices in a fiber-forming die, said orifices being aligned along the face of the die;

b) attenuating the fibers in a stream of hot air to form a fiber stream of microfibers; and c) collecting said microfibers on a collector having a forming surface comprising two rotating collector surfaces or a stationary convex collector, said surface being aligned with said die and substantially parallel to and equidistant from said die such that the fibers form a spirally wound microfibrous sorbent article which is supported on its exterior surface by said forming surface and which is drawn across said forming surface substantially parallel to said die.

* * * * *